United States Patent [19]

Ray

[11] 3,943,674

[45] Mar. 16, 1976

[54] ELEVATED FLOOR ASSEMBLY WITH RELEASABLE TIE MEANS CONNECTING THE PANEL SIDES

[75] Inventor: George F. Ray, Rockville, Md.

[73] Assignee: Liskey Aluminum Inc., Baltimore, Md.

[22] Filed: June 5, 1974

[21] Appl. No.: 476,543

Related U.S. Application Data

[63] Continuation-in-part of Ser. No. 306,417, Nov. 14, 1972, abandoned.

[52] U.S. Cl. ..... 52/126; 52/584; 52/592; 52/758 C; 52/758 D; 52/758 F

[51] Int. Cl.[2] ..... E04F 15/024

[58] Field of Search ..... 52/122, 126, 582, 584, 52/592, 574, 758 C, 758 D, 758 F; 404/41

[56] References Cited

UNITED STATES PATENTS

| | | | |
|---|---|---|---|
| 992,739 | 5/1911 | Meier | 52/582 |
| 2,406,939 | 9/1946 | Boicey | 52/584 |
| 2,681,190 | 6/1954 | Thomson | 52/582 |
| 3,110,064 | 11/1963 | Koontz | 52/584 |
| 3,279,134 | 10/1966 | Donovan | 52/126 |
| 3,285,633 | 11/1966 | Houvener | 52/584 |
| 3,316,680 | 5/1967 | Chrastek | 52/126 |
| 3,379,104 | 4/1968 | Scholl | 404/41 |
| 3,420,012 | 1/1969 | Liskey | 52/126 |
| 3,548,559 | 12/1970 | Levine | 52/222 X |
| 3,616,584 | 11/1971 | Santori et al. | 248/354 S X |
| 3,675,954 | 7/1972 | Konig | 52/584 |
| 3,696,578 | 10/1972 | Swensen et al. | 52/126 X |

*Primary Examiner*—Ernest R. Purser
*Assistant Examiner*—Leslie A. Braun
*Attorney, Agent, or Firm*—Mason, Mason & Albright

[57] ABSTRACT

A false floor assembly of square panels is supported on pedestals above a foundation. The panel corners rest on the pedestals and the adjacent sides of neighboring panels between pedestals are secured together by releasable ties that pass through the sides of each neighboring panel. The area below the panels is accessible by simply removing the ties and lifting one or more panels from the assembly. Loads applied to any one panel in the assembled floor are resisted by neighboring panels and the floor remains substantially flat without uneven deflections.

9 Claims, 21 Drawing Figures

FIG. 4
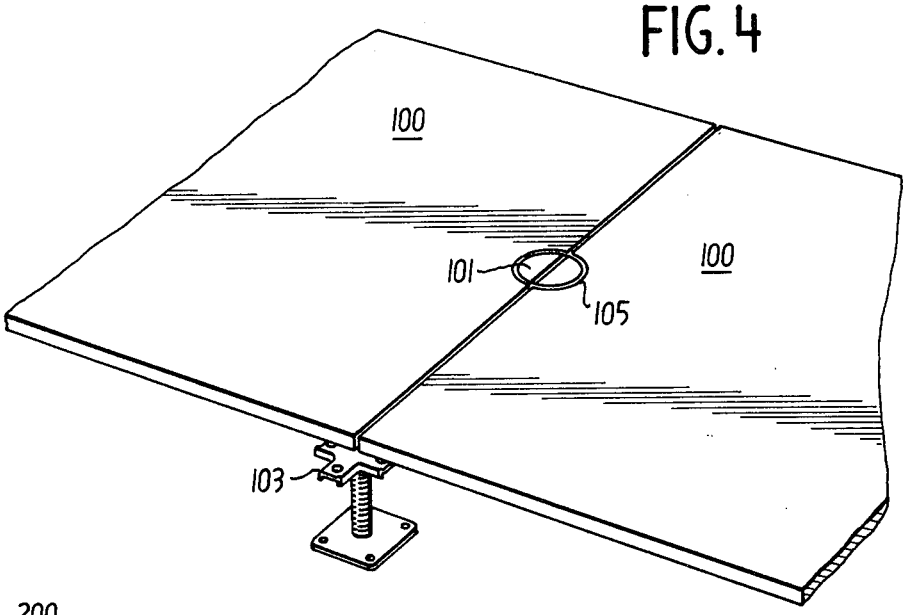
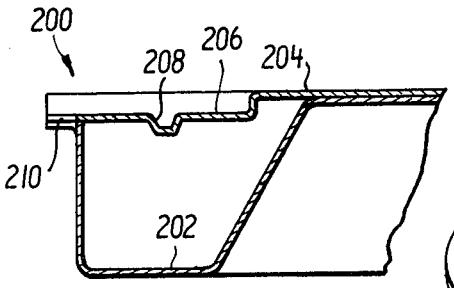
FIG. 9
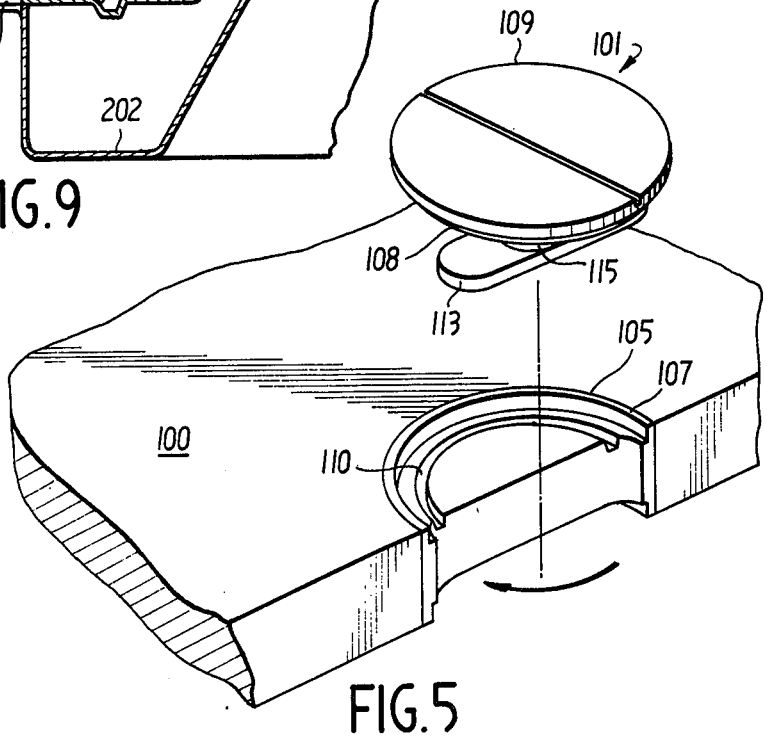
FIG. 5
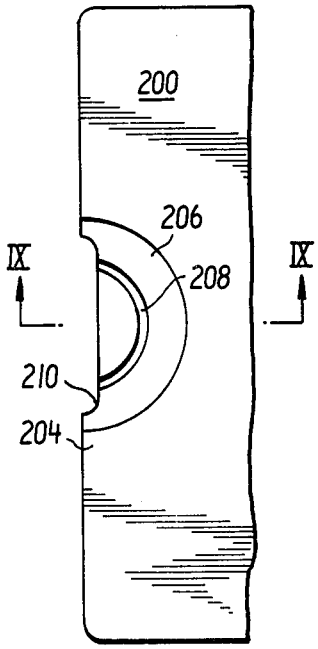
FIG. 8

ELEVATED FLOOR ASSEMBLY WITH RELEASABLE TIE MEANS CONNECTING THE PANEL SIDES

This application is a continuation-in-part of Ser. No. 306,417 filed Nov. 14, 1972, now abandoned.

This invention pertains to improved design of floor assemblies known commonly as: elevated floors, access floors, false floors, false decks, pedestal floors or raised floors.

These floor assemblies consist basically of floor panels supported above the base floor or foundation by pedestals. The pedestals normally are located so as to provide support at panel corners and are in some cases supplemented by horizontal stringer members which form a grid when attached to, or when they rest upon the pedestals. These stringers provide support along the panel sides, decreasing panel deflection under applied load and further provide additional sealing or pressure drop at the panel junctions when the space between the access floor and the base floor is used as a plenum or duct for air circulation.

Elevated or false floors are presently being used where substantial numbers of electrical cables are required to interconnect various types of equipment and where it is desirable to maintain accessibility of these cables for ease of installation, change, or removal. The common use currently is computer room flooring. In such installations, cables are laid along the base floor and under the access floor and are accessible by removing floor panels in that specific area.

Access floors are also becoming attractive for use in applications other than computer room installations. In comparison to conventional building systems where piping for various uses, ducting, wiring, etc., are installed within floors or ceilings providing little or no access without considerable difficulty, the access floor is much more desirable. As costs become more comparable, use of access flooring for virtually any type of building use becomes more attractive. Building rearrangement, partition changes, equipment relocation, desk rearrangement, underfloor system repair or change, addition of services such as air conditioning or electrical circuits all become relatively simple in buildings utilizing access flooring.

The plenum formed by the base floor, the access floor and the surrounding walls, serves as a convenient means of conditioned air distribution. Air is forced into this plenum and distributed to the room via selectively located panels which incorporate openings to allow passage of the air into the room. These panels may have grills, or may be perforated to allow flow and may incorporate dampers if desired.

Another advantage here is that in order to achieve proper air conditioning balance at initial installation, or upon change in room arrangement or change in required air distribution, distribution panels may be relocated by interchanging these with other panels anywhere in the floor. Also, common panels may be replaced by distribution panels at any time to increase the number of distribution points.

In a stringerless type of system, floor loading near the edge of a panel results in downward deflection of that panel and this in turn causes variation in elevation from this edge to the edge of the adjacent panel. In a system which utilizes stringers this deflection is reduced somewhat, however, this reduction depends upon the stringer integrity and fixity at the pedestals. Since loads are transferred to the stringer eccentrially this type of system requires quite rigid construction to provide significant benefit.

The object of this invention is to interconnect the edges of adjacent panels such that the two panels act together in resisting vertical forces imposed by floor loading and/or such that the interconnect will resist lateral separation of the floor panels. The interconnection may be such that adjacent panel edges are structurally attached along the entire edge length or at a point or points along the edge.

While this interconnection is primarily for use where stringers are not utilized, it may also be used in conjunction with stringers in order to obtain minimum deflection characteristics, optimum floor strength, lateral stability and plenum sealing.

In addition to the advantage of causing a portion of the load imposed on a given panel to be distributed to the adjacent panel, these panels will deflect together thus avoiding hazardous variations in elevation from the floor surface of one panel to the next.

Deflection of a panel when loaded near an edge is virtually halved since this load is shared by the adjacent panel, greatly increasing floor load capacity.

This interconnected panel floor system, being a more homogeneous platform, corresponds more nearly to floors of conventional construction while providing convenient access to any systems installed under the floor.

Interconnection methods may be such that any given panel may be removed without the necessity of removing additional panels, or may be such that "limited" access is provided, i.e., "key" panels must be removed thus allowing removal of those which are captivated by the key panels.

Flooring systems of the type described may include panels having floor surfacing such as tile of various materials, high pressure laminates or carpet bonded in place to each panel individually, or may have floor surfacing material installed over the completed floor system. The latter may consist of carpeting, laid over the completed floor system, which can be lifted before removing panels.

Where floor surfacing material are not bonded in place, panel attachment device access through the top of the panel is less objectionable so long as the upper surface of the installed panel, including the area of the device, is sufficiently uniform such that discontinuities are not easily detectable when flooring surface is in place. Attachment device access through the panel upper surface may be utilized in systems having bonded in place coverings also, provided discontinuities do not present walking or other hazards.

It is an object of the present invention to provide a floor assembly of panels wherein the adjacent sides of neighboring panels are tied together to resist load deflections in horizontal and vertical directions so that the assembly remains flat and uninterrupted.

It is a further object to accomplish the above with structures that permit easy and quick access to the space or area below the floor assembly. These and other objects are accomplished with the structures disclosed herein wherein:

FIG. 4 is a plan view of a false floor with modified panels for side-by-side attachment;

FIG. 5 is a plan view of the FIG. 4 floor with one panel removed;

FIG. 8 is a plan view in part of a panel with a modified socket;

FIG. 9 is a section view taken along the lines IX — IX of FIG. 8;

Figure 1:
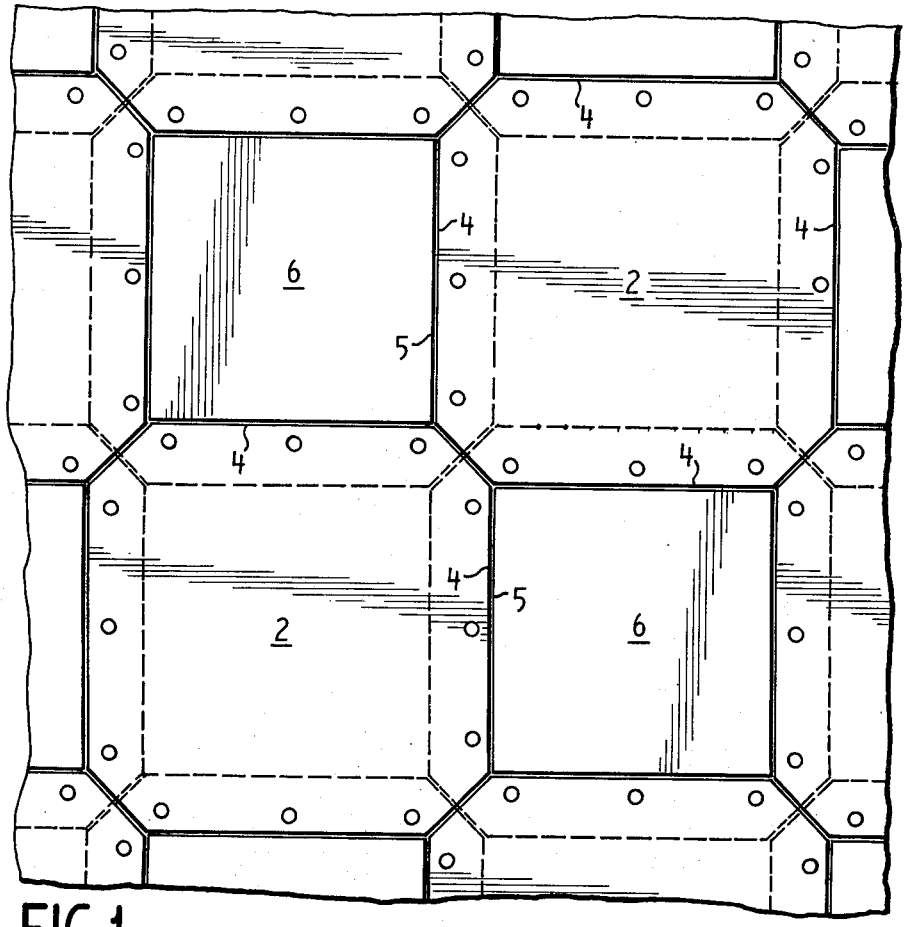
FIG. 1 is a plan view of an assembled false floor.

In FIG. 1, an assembly of dissimilar square panels is shown in which "free" panels 2 have edges 4 around all four sides. The edges 4 overlie the rims 5 of "captured" panel 6 which also surround all four sides of that panel. The rims 5 are depressed when seen in section (FIG. 3) to accept the edges 4 and present a flush upper surface which can have a tread surface of tile, carpet, or the like applied. The edges 4 and rims 5 are shown greatly exaggerated for purposes of illustration. For instance, on a 30 inch panel, the edge 4 or rim 5 need only be 1 inch or less in width.

Each free panel 2 and captured panel 6 is preferably a hollow structure with upper metal sheets 7 and 8 respectively. The lower sheets 9 and 10 of the panels 2 and 6 respectively are spaced from the upper sheets. Thus, sheet 9 is bent upwardly and sheet 8 bent downwardly in the free and captured panels to form the sides of panels. The extremities of sheets 8 and 9 are again bent to coextend and terminate with upper sheet 7 and lower sheet 10 to form edges 4 and flanges 12 respectively.

Each panel 2 and 6 is hollow and webbed with internal stiffeners or provided with a solid core. The stiffeners can be formed between the bottom and top sheets as shown in U.S. Pat. No. 3,420,012 or provided as with other well known web structures in the panel art.

Figure 2:
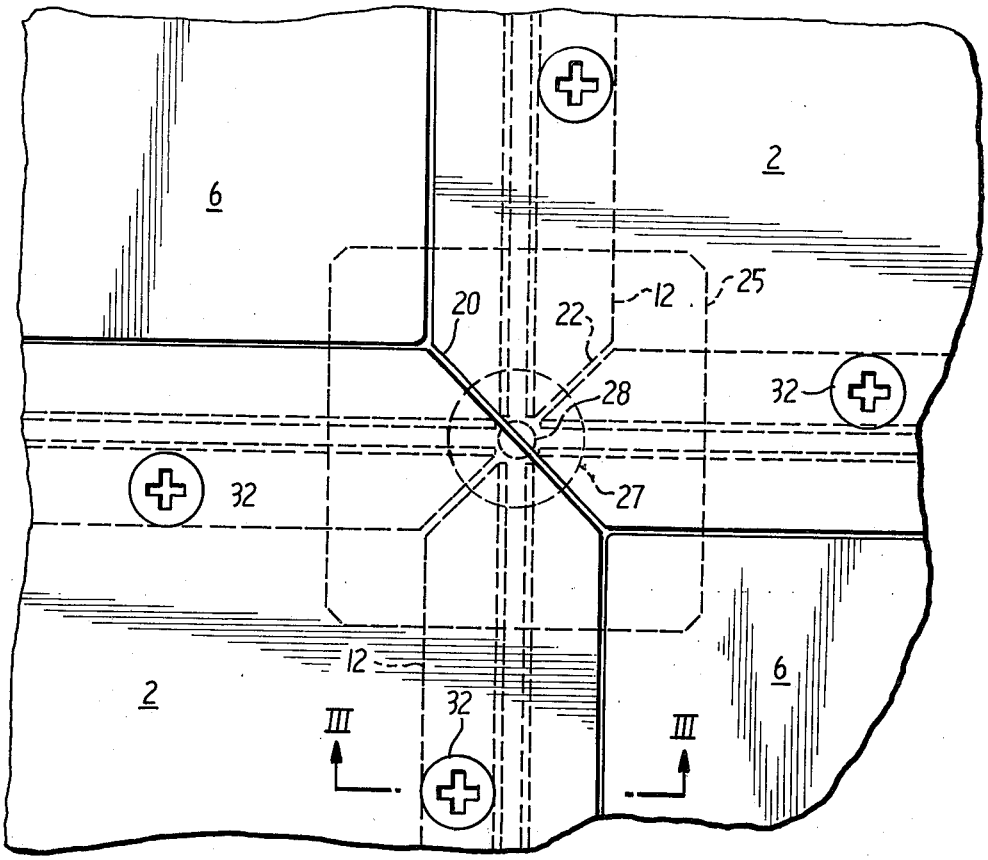
FIG. 2 is an enlarged plan view of adjoining free panel corners resting on a pedestal.
Figure 2A:
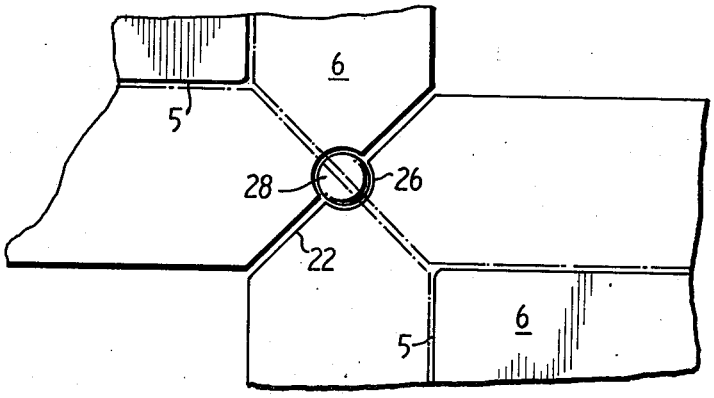
FIG. 2A is an enlarged plan view of adjoining corners of the captured panels of FIG. 2 with the free panels omitted.

Each panel has truncated corners indicated at 20 for the free panels and at 22 for the captured panels. The corners 22 underlie those corners 20 of the free panels 2 and are shown in phantom in FIG. 2. Underlying the juncture of all four corners is a pedestal cap 25 also shown in phantom in FIG. 2. The cap 25 can simply be a square cap, when seen in plan, on a screw stem 27 and stand like that of U.S. Pat. No. 3,279,134 or 3,316,680 for height adjustment. In FIG. 2A, the truncated corners 22 of captured panels 6 are each notched at 26 so that opposing notches leave an opening that receives a spacer pin 28 fitted in a hole in the center of cap 25. The notches 26 and pin 28 are not fully visible when the free panels are fitted in place and the floor completely assembled.

Figure 3:
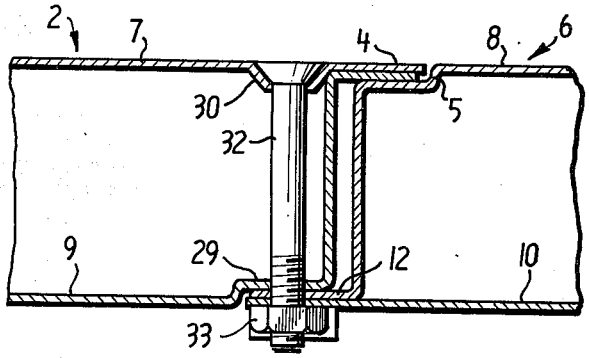
FIG. 3 is a section in elevation taken along the lines III — III of FIG. 2.
Figure 10:
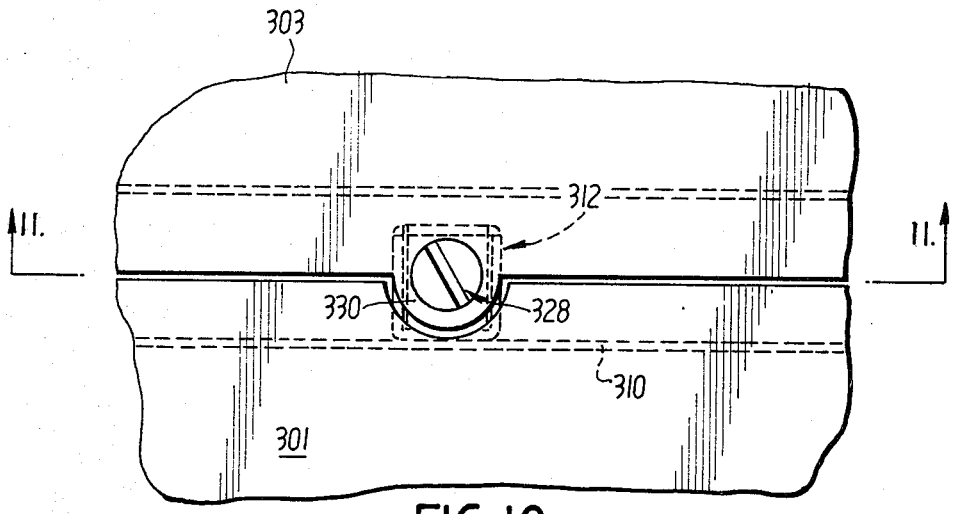
FIG. 10 is a fragmented plan view of two modified panels showing the tie connection.
Figure 11:
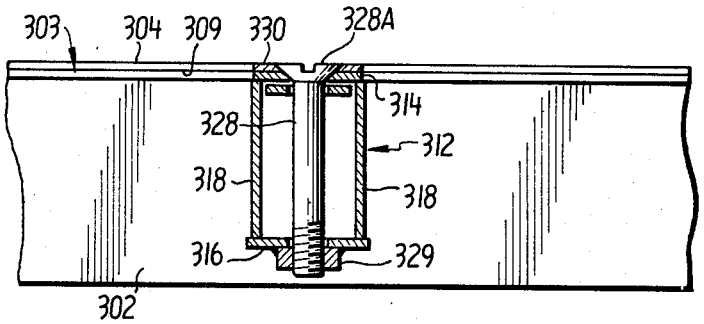
FIG. 11 is a section taken along the lines 11 — 11 in FIG. 10.

The captured panels 6 have flanges 12 that underlie the lower sheets 9 of free panels 2. The peripheries 29 of the lower sheets 9 are indented to receive the flanges 12 as seen in FIG. 3. Each panel is provided with a plurality of holes through which ties are passed to lock adjoining panel sides together.

It is preferred that the top sheet 7 of each free panel have dimples 30 to receive the heads of round screw bolts 32 flush, and that holes also be provided through the peripheries 29 of bottom sheet 9 as well as the flanges 12 of the captured panels 6. A caged nut 33 can be positioned to receive each bolt 32 when the false floor is assembled. The holes in each panel for receiving bolts 32 can be enlarged to allow the bolts some play for ease of fitting.

The assembly of FIG. 1 can be easily assembled and ready access to the area below the floor is available by simply removing the screw bolts 32 of any free panel 2 and, if necessary, also raising any captured panel 6 by first removing the surrounding free panels 2.

In FIGS. 4 and 5, a portion of a false floor of side-by-side square panels 100 is shown in which the adjacent sides of the panels are connected to one another by tie means in the form of a circular rotatable plug 101. The corners of the panels are shown resting on pedestals 103 of the type disclosed in U.S. Pat. No. 3,616,584. Along each side of each panel 100 and preferably midway of the sides' lengths, a well 105 is cut out for receiving a socket 107. The plug 101 fits in adjoining sockets 107 when the wells 105 are matched in neighboring side-by-side panels.

Figure 6:
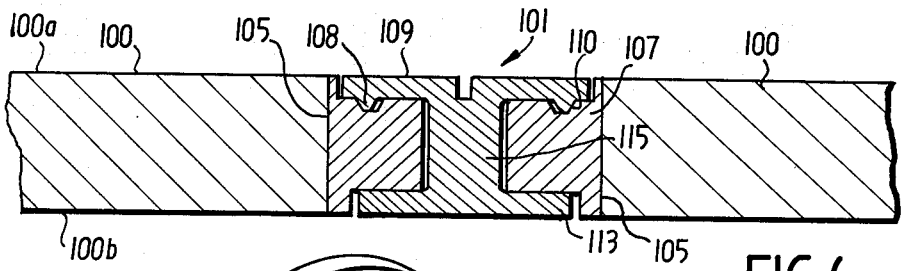
FIG. 6 is an enlarged section of neighboring panels tied together by a plug.
Figure 7:
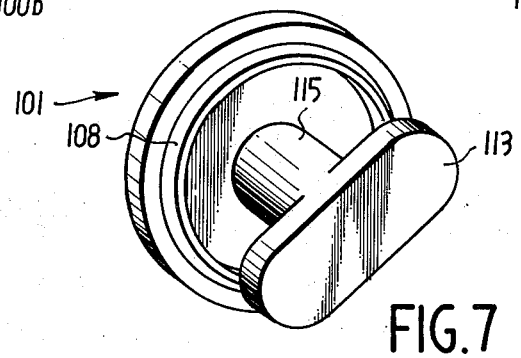
FIG. 7 is a perspective view of the bottom of the locking plug.

As seen in FIGS. 6 and 7, the plug 101 has a circular top portion 109 with concentric ribs 108 that extend downwardly to fit in circular grooves or guide tracks 110 of sockets 107. The bottom of the plug is an elongated lug 113 that can pass through adjoining wells 105 in unlocked position, but will closely bear on adjoining sockets 107 to lock neighboring panels 100 together when turned 90° to a locked position. Thus, plug 101 affords support to the top and bottom of each adjacent panel 100 and ties their adjacent sides together. The top portion 109 can be keyed or slotted so that the plug 101 can be rotated.

Top portion 109 is connected to bottom lug 113 by a stem 115. When turned to a locked position, the plug 101, and specifically the lug 113, bridges the bottom surfaces of adjacent sockets 107 and bears on these surfaces since the length of stem 115 is chosen to allow no play between the plug and the upper and lower surfaces of the sockets 107 in the panels 100. The sockets 107 are recessed at their bottoms to receive lugs 113.

The panels 100 are identical to one another and can be the same as those shown in Pat. Nos. 3,420,012 and 3,548,559 which have been cut out to receive one or more sockets 107 along their sides. The upper and lower sheets 100*a* and 100*b* respectively are metal, preferably steel to receive and retain steel sockets 107. If the panels are all metal, such as steel, the sockets can be welded in place. With solid wood cores, the sockets can be bolted or otherwise affixed in the panel's sides.

In use, the panels 100 are first assembled on pedestals and supported above the true floor or foundation and then plugs 101 are inserted and rotated to capture or tie adjacent panel sides together. When the plugs 101 are locked, their upper surfaces are flush with those of panels 100. With or without stringers that bridge pedestals 103, and exceptionally strong false floor assembly is formed that resists uneven deflections and maintains a level, even false floor surface.

FIGS. 8 and 9 show a metal panel 200 the same or similar to that disclosed in U.S. Pat. No. 3,696,578 wherein a formed bottom metal sheet or pan 202 and flat top metal sheet 204 are welded to one another at their edges. The two sheets are spaced apart with metal struts or webbing formed in the bottom sheet 202 providing a trussed structure.

The top sheet 204 is coined to have a circular depressed area 206 having a groove or guide track 208 to receive rib 108 of plug 101. The bottom pan 202 is blanked to provide relief for the top sheet configuration and the panel edge is cut out at the edge portion 210 of the depressed area 206. When abutting panels 200 are assembled, the lug 113 can be entered through the opening formed by adjacent cutouts at 210. The lug 113 will bear on the undersides of the raised ribs of adjacent panels when the plug 101 is rotated. Thus, the panel construction of FIGS. 8 and 9 includes a built-in or integral socket that receives the rotatable plug 101.

In FIGS. 10 – 13 an assembly of modified panels is shown in which one set of captured panels 301 are arranged in checkerboard relationship with a second set of free panels 303. Each captured panel 301 is surrounded by free panels 303 and each side 310 of panel 301 is provided with a bracket member 312 that can be welded or otherwise affixed to the side 310. The panels 301 and 303 are preferably metal panels similar to that shown in FIG. 8 and 9 in which a flat top metal sheet 304 is welded to a bottom metal pan 302 at their edges 309. The means for interconnecting the panel sides together comprises a bracket member 312 secured to all four sides of panel 301.

Figure 12:
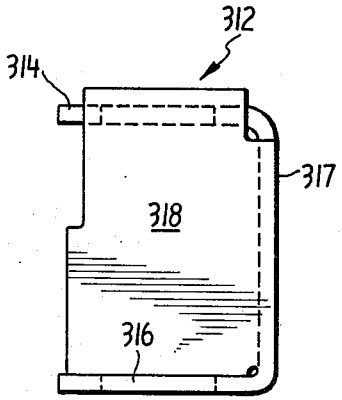
FIG. 12 is a side elevation of a bracket tie.
Figure 14:
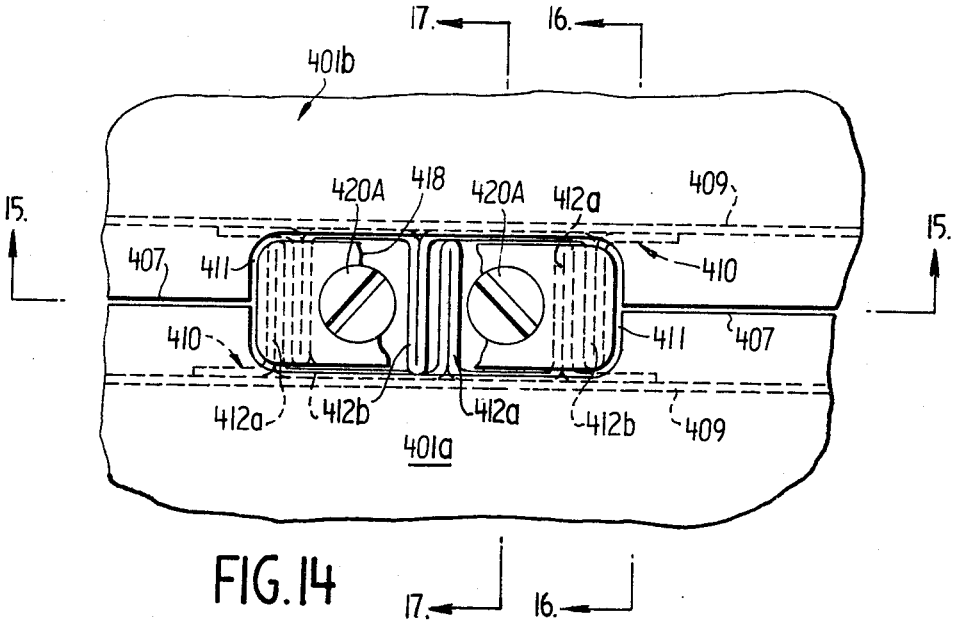
FIG. 14 is a fragmented plan view of a further modified panel tie connection.
Figure 15:
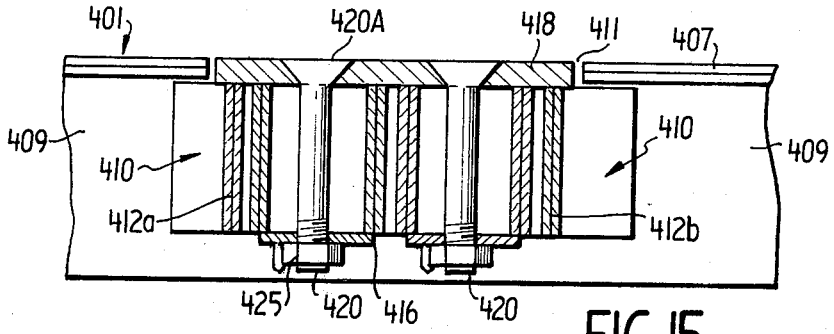
FIG. 15 is a section taken along the lines 15 — 15 of FIG. 14.
Figure 16:
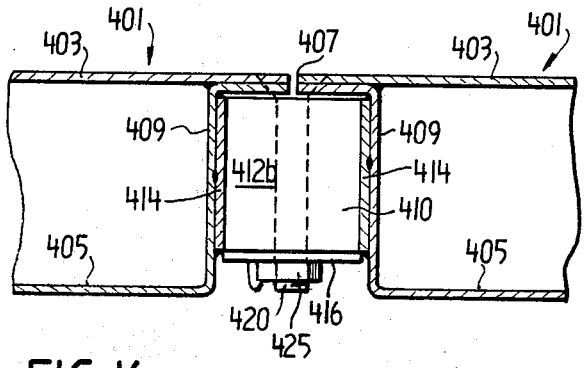
FIG. 16 is a section of the tie bracket in place taken along the lines 16 — 16 of FIG. 14.
Figure 17:
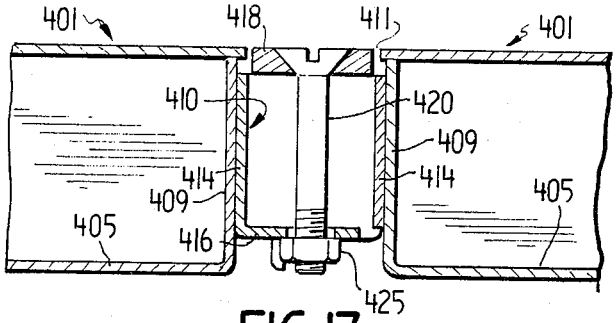
FIG. 17 is a section taken along the lines 17 — 17 of FIG. 14.
Figure 18:
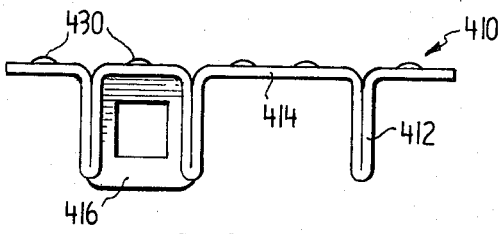
FIG. 18 is a plan view of the tie bracket shown in phantom in FIG. 14.
Figure 19:
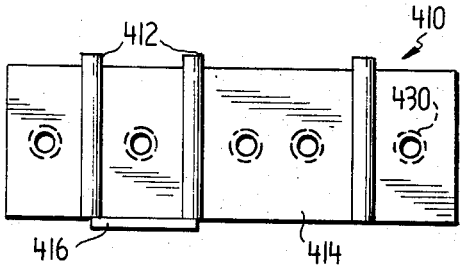
FIG. 19 is an elevation of the tie bracket.

The bracket member 312 is best shown in FIG. 12 and has an upper ear 314 and lower ear 316 which ears are apertured. The back 317 of bracket 312 can be welded to each side 310 of panel 301 and elongated flanges 318 interconnect ears 314 and 316 to reinforce same.

Free panel 303 is essentially the same as panel 301 except there is no bracket, but instead a perforated tab 330 is integrally formed or otherwise affixed to upper sheet 304 to project outwardly in register with bracket member 312 on panel 331 and closely overlie upper ear 314. A tie, such as a threaded screw or bolt 328 can be passed through tab 330, ears 314 and 316 and be received in retaining means, in this case a nut 329 that has been welded to the underside of ear 316. Alternatively, the tab 330 can be welded as an extension of upper panel sheet 304 while nut 329 can be caged to allow lateral freedom while ensuring that bolt 328 is releasable after it has been fastened. The head 328A of bolt 328 is received in a complimentary recess of tab 330 to be flush with the upper floor surface.

Figure 13:
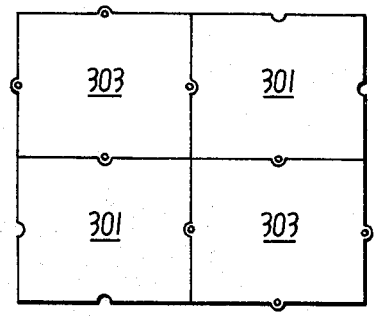
FIG. 13 is a plan view of an assembled floor showing a captured-free panel arrangement.

The assembled floor of FIG. 13 illustrates the checkerboard pattern of free panels 303 with captured panels 301. Like the assembly of FIGS. 1 – 3, the floor shown in FIG. 13 is a "50% acessible" assembly. Thus, the area below any panel 301 is accessible only by first removing adjacent free panels 303.

In FIGS. 14 – 20 the floor asembly is formed of identical panels 401, each of which can be the same as the FIGS. 8 and 9 panel except for the tie bracket and securing structure for the sides. Each panel 401 has an upper sheet 403 and a bottom pan 405 which are welded at the juncture of their edge 407. Each panel side 409 has a bracket 410 with an integral back part 414 welded to the pan 405 and a portion of the edge 407 is removed immediately above the bracket 410 to leave a space 411 having a length of about the same width of bracket 410

Each bracket 410 includes three adjacent cheek projections 412 which can be spaced apart, doubled over portions of a bent metal strip forming the major part of bracket 410. The three projections **412*a* of panel 401*a* are spaced apart to leave two adjacent and open recesses, a first of which is wider than the second recess. The first wider recess receives those projections 412*b* of the adjacent panel 401*b* which form the narrower recess in the panel 401*b* as seen in the drawings. The panels 401*a* and 401*b* as well as their corresponding brackets and projections 412*a* and 412*b*** are elongated flanges that are preferably identical and designated by different numbers in the drawings solely for ease of description.

The narrower recess formed by two projections **412*a* has a bottom formed by a tab 416 that can be welded or affixed to the bottom sides of the two projections 412*a* defining the narrower recess. The tab 416 is perforated and can be threaded or have a captured nut 425** to engage tie means.

Thus, the projections **412*a* and 412*b* of brackets 410 of adjacent panels interfit with one another, the narrower recesses being received in wider recesses between projections 412*a* and 412*b* and each recess has an apertured tab 416 at the bottom thereof when the panels 401 are assembled and viewed in plan. Also, each panel 401 can be identical and each bracket 410 affixed at the same point or points along each side 409. It will be appreciated that more than one bracket 410 can be affixed to each side 409 but, usually only one bracket 410 need be secured to each panel side 409,** midway of the sides when the latter are about two feet or less in length.

Figure 20:
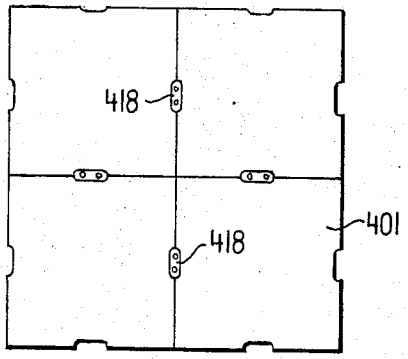
FIG. 20 is a plan view of an assembled floor.

A top plate 418 is dimensioned to fit within adjoining spaces 411 of adjacent panels 401 and bridge the tops of all projections 412 of both brackets 410 when the neighboring panels 401 are placed adjacent one another. The thickness of plate 418 is such that a floor assembled of panels 401 presents a smooth surface as seen in FIG. 20. The plate 418 is apertured in two places to be in general register with the perforations of tabs 416 so that tie means, such as threaded bolts 420 can be passed through the apertures and be received in threaded perforations of tabs 416. Alternatively, the bolts 420 can be received in welded or caged nuts 25 loosely secured at the bottom of tabs 416. The bolts 420 have heads 402A that interfit flush with the apertures of plate 418 to provide a flat surface.

It will be appreciated that the space 411 of each panel can be the same and each bracket 410 can be offset from the middle of the space 41 so that a tight interfit between the panels 401 is realized which ensures that an assembled floor has maximum strength and resistance to load deflection.

Also, each panel 401 can be identical and any of the four sides of the panels 401 interchangeable. Each bracket 410 can be made from a single piece of strip metal with spot weld dimples 430 for ready fitting to the sides 409 of the panels 401.

Numerous modifications have been disclosed and applicant does not intend the scope of the invention to be limited except as appears in the claims.

What is claimed is:

1. An elevated false floor assembly of panels comprising a plurality of square panels arranged side-by-side in rows and supported on pedestals at their corners to leave a plenum below said floor assembly, said panels each having sides with releasable tie means connecting neighboring sides of adjacent panels together and said tie means being located intermediate the corners of the panels, said panels being load-bearing with spaced apart upper and lower metal sheets which are joined together at the outer perimeters of said panels, at least some of said panels having a bracket with projection means at each of its sides, and said projection means comprising spaced apart vertically elongated flanges that extend between adjacent panel sides and afford load bearing supports to said panels intermediate their corners, said tie means extending through said brackets and releasably securing the sides of adjacent panels together, whereby both vertical and horizontal deflections of one panel are resisted and shared by neighboring panels, said plenum being readily accessible by disconnecting said tie means at the upper surface of said floor assembly, and said panels being liftable from surrounding assembled panels and removable.

2. The floor assembly of claim 1, wherein each side of said panels comprises an apertured bracket and said tie means includes common bolt means that is passed through the brackets of neighboring sides of adjacent panels.

3. The floor assembly of claim 2, wherein said bolt means is threaded and a nut is held on the bottom of said bracket to engage said bolt.

4. The floor assembly of claim 1, wherein the outer surfaces of each panel side has a bracket affixed thereto and each bracket has projections that interfit with the projections of a juxtaposed bracket of a neighboring panel side, an upper apertured plate bridging the projections of two brackets on adjacent panel sides at their perimeters, said upper plate being secured to interconnect said brackets with releasable ties.

5. The floor assembly of claim 4, wherein each bracket is comprised of three spaced apart substantially vertical projections that define two side-by-side recesses and a first recess is wider than the second recess.

6. The floor assembly of claim 5, wherein said brackets each have a lower perforated tab that bridges at least two of said projections and forms the bottom of said second recess, said tie means being bolts that are passed through said apertured plate and the perforated tabs of adjacent panels to secure same together.

7. The floor assembly of claim 4, wherein the perimeters of adjacent panels have matching spaces that receive said plate and present a flush surface.

8. The floor assembly of claim 1, wherein there are two sets of dissimilar panels arranged in checkerboard relationship, each panel of one of said sets having an apertured tab member extending outwardly from its upper surface at each perimeter thereof and each panel of the other set having a bracket at each side thereof, said bracket comprising an upper and a lower apertured ear which are in alignment with said apertured tab member, said tie means being releasable ties that extend through said member and said ears to secure adjacent panel sides together.

9. The floor assembly of claim 8, wherein said ties are bolts each of which interfits with retaining means at the lower ears of the brackets.

* * * * *